US009068704B2

(12) United States Patent
Burton et al.

(10) Patent No.: US 9,068,704 B2
(45) Date of Patent: Jun. 30, 2015

(54) INTEGRATED SIGNAL LIGHT HEAD

(75) Inventors: Thomas R. Burton, Germantown, TN (US); John H. Vines, Toms River, NJ (US); Richard Liskoff, Manasquan, NJ (US); John Patrick Peck, Manasquan, NJ (US); Aleksandr Olegovich Spiridonov, Allentown, NJ (US)

(73) Assignee: Dialight Corporation, Farmingdale, NJ (US)

( * ) Notice: Subject to any disclaimer, the term of this patent is extended or adjusted under 35 U.S.C. 154(b) by 351 days.

(21) Appl. No.: 13/572,373

(22) Filed: Aug. 10, 2012

(65) Prior Publication Data

US 2013/0039044 A1 Feb. 14, 2013

Related U.S. Application Data

(63) Continuation-in-part of application No. 12/887,058, filed on Sep. 21, 2010, now Pat. No. 8,797,183.

(51) Int. Cl.

| | |
|---|---|
| ***F21V 15/00*** | (2006.01) |
| ***F21L 4/02*** | (2006.01) |
| ***F21L 2/00*** | (2006.01) |
| ***F21V 15/01*** | (2006.01) |
| ***G08G 1/095*** | (2006.01) |
| *F21W 111/02* | (2006.01) |
| *F21Y 101/02* | (2006.01) |

(52) U.S. Cl.

CPC ... *F21L 4/02* (2013.01); *F21L 2/00* (2013.01); *F21V 15/01* (2013.01); *G08G 1/095* (2013.01); *F21W 2111/02* (2013.01); *F21Y 2101/02* (2013.01)

(58) Field of Classification Search

CPC . G06G 1/095–1/096; F21W 2111/00–2111/02
USPC ..... 362/231, 362, 267; 340/907; 116/63 R
See application file for complete search history.

(56) References Cited

U.S. PATENT DOCUMENTS

| | | | | |
|---|---|---|---|---|
| 2,967,293 | A | 1/1961 | Paulson | |
| 3,030,165 | A | 4/1962 | Nagy | |
| 4,075,402 | A | 2/1978 | Okamoto | |
| 5,010,336 | A | 4/1991 | Mosele et al. | |
| 5,633,629 | A | 5/1997 | Hochstein | |
| 5,663,719 | A * | 9/1997 | Deese et al. | 340/912 |
| 5,664,874 | A | 9/1997 | Winterer | |
| 6,107,941 | A | 8/2000 | Jones | |
| 6,392,563 | B1 * | 5/2002 | Paquette et al. | 340/907 |

(Continued)

FOREIGN PATENT DOCUMENTS

| | | |
|---|---|---|
| AT | 505 154 | 11/2008 |
| EP | 2 211 385 | 7/2010 |
| WO | WO 2011/032219 A1 | 3/2011 |

OTHER PUBLICATIONS

Supplemental European Search Report EP 11 82 7107, Feb. 24, 2014, consists of 6 pages.

(Continued)

*Primary Examiner* — Robert May

(57) ABSTRACT

The present disclosure relates generally to an integrated signal light head. In one embodiment, the integrated signal light head includes a molded housing for holding at least one light emitting diode (LED) light source and a power supply compartment coupled to the molded housing. As a result, a power supply may be remotely located and independent of the at least one LED light source.

19 Claims, 12 Drawing Sheets

(56) References Cited

U.S. PATENT DOCUMENTS

| | | | | |
|---|---|---|---|---|
| 6,459,175 | B1 | 10/2002 | Potega | |
| 6,522,263 | B2 | 2/2003 | Jones | |
| 7,237,924 | B2 * | 7/2007 | Martineau et al. | 362/231 |
| 7,307,546 | B1 | 12/2007 | Partap | |
| 7,385,481 | B2 | 6/2008 | Sommers et al. | |
| 7,390,107 | B2 * | 6/2008 | Blumel | 362/244 |
| 7,434,968 | B2 * | 10/2008 | Wu | 362/375 |
| 7,553,044 | B2 * | 6/2009 | Wedell | 362/247 |
| 7,586,421 | B2 | 9/2009 | Witte et al. | |
| 7,671,760 | B2 | 3/2010 | Vallejo, Sr. | |
| 7,733,242 | B2 | 6/2010 | Bertels et al. | |
| 7,976,180 | B1 | 7/2011 | Haun et al. | |
| 8,295,059 | B1 | 10/2012 | Conroy | |
| 2002/0027510 | A1 | 3/2002 | Jones et al. | |
| 2004/0120152 | A1 | 6/2004 | Bolta et al. | |
| 2006/0039150 | A1 | 2/2006 | Mayer et al. | |
| 2007/0139921 | A1 | 6/2007 | Wu | |
| 2007/0290887 | A1 | 12/2007 | Pleasanton | |
| 2008/0129543 | A1 | 6/2008 | Lee | |
| 2008/0150757 | A1 | 6/2008 | Hutchison | |
| 2009/0154171 | A1 | 6/2009 | Xiao | |
| 2010/0026520 | A1 | 2/2010 | Witte et al. | |
| 2010/0187549 | A1 | 7/2010 | Chen | |
| 2012/0069561 | A1 | 3/2012 | Burton et al. | |

OTHER PUBLICATIONS

International Search Report and Written Opinion for International Patent Application Serial No. PCT/US2013/054351, mailed Aug. 19, 2013, consists of 11 unnumbered pages.

International Search Report and Written Opinion for PCT/US2011/023579, Mar. 30, 2011, consists of 8 pages.

* cited by examiner

INTEGRATED SIGNAL LIGHT HEAD

RELATED APPLICATIONS

This application is a continuation-in-part of U.S. patent application Ser. No. 12/887,058, filed on Sep. 21, 2010 now U.S. Pat. No. 8,797,183, entitled INTEGRATED SIGNAL HEAD, which is hereby incorporated by reference in its entirety.

BACKGROUND

Previous signal light heads, such as traffic lights, were designed for incandescent light sources. However, signal light heads have been transitioning to a light emitting diode (LED) based light source. As a result, the incandescent-based signal light heads must be retrofitted with an LED-based light module.

In addition, previous incandescent-based signal light heads were designed to include a set of components including a reflector, socket, a hinge, and a locking mechanism. These components may be removed and the signal head may be retrofitted with an LED-based light module. A power source for each traffic signal light is contained in the individual LED-based light modules. The power source typically converts the high-voltage AC line input to a low-voltage DC output for the LEDs. The power source is located inside the LED-based light module. In the event of a failure of the power source the entire LED-based light module must be removed and replaced. Consequently, the rest of the LED-based light module, including the LEDs, the housing, wiring, connectors, and the lenses would be wasted to simply replace a power supply.

SUMMARY

The present disclosure relates generally to an integrated signal light head. In one embodiment, the integrated signal light head comprises a molded housing for holding at least one light emitting diode (LED) light source and a power supply compartment coupled to the molded housing.

The present invention also provides an integrated traffic signal light head. In one embodiment, integrated traffic signal light head comprises a molded housing for holding at least one light emitting diode (LED) based traffic signal light, wherein the at least one LED based traffic signal light is powered by a remotely located power supply and a power supply compartment coupled to the molded housing.

The present invention also provides a second embodiment for an integrated signal light head. In one embodiment, the integrated signal light head comprises a molded housing for holding at least one light emitting diode (LED) based traffic signal light and a power supply compartment coupled to the molded housing, wherein the power supply compartment includes at least one receptacle for receiving a plug-and-play power supply.

BRIEF DESCRIPTION OF THE DRAWINGS

So that the manner in which the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

Embodiments of the present disclosure are directed towards an integrated signal light head. As noted above, previous signal light heads have been retrofitted with LED-based light modules connected to a housing. However, when the power supply would fail, the entire module would need to be replaced. In the case of the incandescent light source, no power supply was needed so only the bulb was replaced.

In one embodiment, the power supply may consist of simple batteries. In a further embodiment, the power supply may consist of electronics that convert an input constant voltage to an output constant voltage that drive the LEDs. In an even further embodiment, the power supply may consist of electronics that convert a constant voltage to a constant current to the LEDs. For example, the power supply may convert a voltage greater than 100 volts to a constant current of less than 10 amps. The power supply may consist of various components, including but not limited to, one or more circuit boards, capacitors, resistors, inductors, transformers, fuses, diodes, linear regulators, integrated circuits (ICs), variacs, and field effect transistors (FETs).

However, in the case of the LEDs, the life of the LED light source is much greater than the life of the power supply. As a result, the chances of simply having to replace the power supply will be greater with LED based signal light heads. With the current design, replacing a complete LED traffic signal module due to a failure of the power supply is wasteful because other components, which may still be fully functional, are discarded simply to replace a failed power supply.

In addition, in an LED-based light module that was retrofitted into a signal head traditionally used for incandescent light bulbs, the signal head would include components such as a main housing, a door, a gasket, a hinge, a fastener, a terminal block and wiring. In addition, due to the retrofitting an air gap would exist inside the housing between the LED of the retrofitted module and the housing. The air gap was undesirable due to its insulating effects that prevented heat to dissipate away from the LED.

By creating an integrated signal light head that has a remotely located power supply compartment, many of the components from the retrofitted design could be eliminated. In addition, the undesirable air gap could also be removed.

Figure 1:
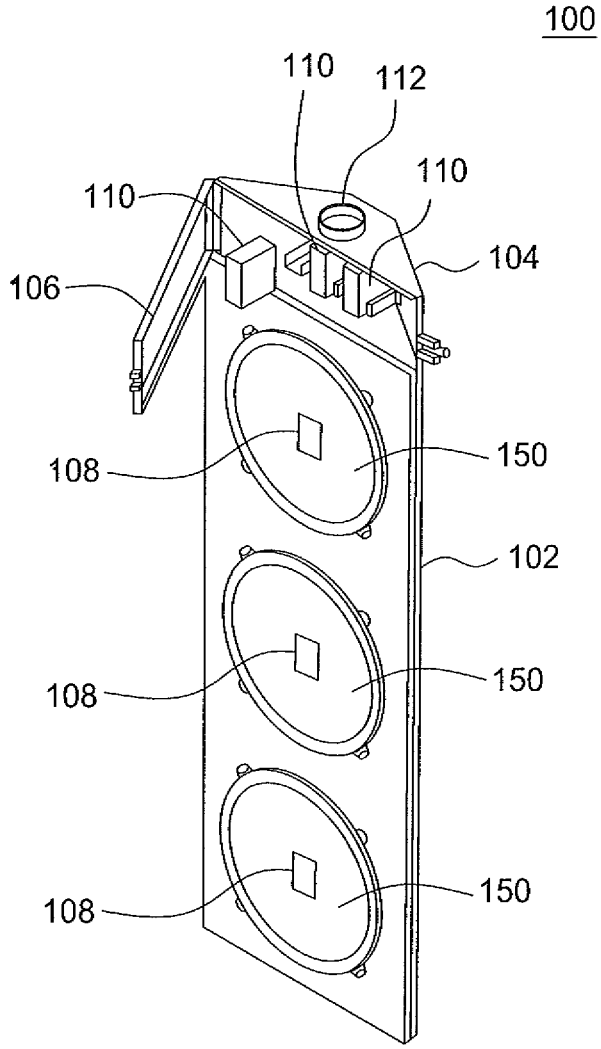
FIG. 1 depicts an isometric view of one embodiment of an integrated signal light head.

FIG. 1 illustrates an embodiment of an integrated signal light head 100. Although the integrated signal light head 100 is illustrated by example as a traffic signal light head, it should be noted that the integrated signal light head may be designed specifically for other applications as well, such as rail lighting, subway lighting, interior lighting fixtures and the like.

In one embodiment, the integrated signal light head 100 includes a molded housing 102 for holding at least one light source 108. In one embodiment, the light source 108 may be one or more LED light sources. The molded housing 102 may also include an outer lens 150 for each light source 108. In one embodiment, the outer lens 150 may be extruded as part of the molded housing 102. That is, the outer lens 150 does not have to be a separately attached lens. In one embodiment, the outer lens 150 may be used to spread the light to a desired distribution, thus eliminating the need for an inner Fresnel lens.

In one embodiment, the at least one light source 108 is located on an inside portion of the molded housing 102 and the outside of the molded housing 102 is exposed to outside air. In other words, the light source 108 is located on the inside portion of the molded housing 102 and an outside portion of the molded housing 102 directly opposite the light source 108 is exposed to outside air. This may improve the cooling to the at least one light source 108 by eliminating an insulating air pocket that existed between the housing and the retrofitted LED-based light module used in previous designs. Outside air may be defined as ambient air outside of any enclosures, building, etc.

Figure 4:
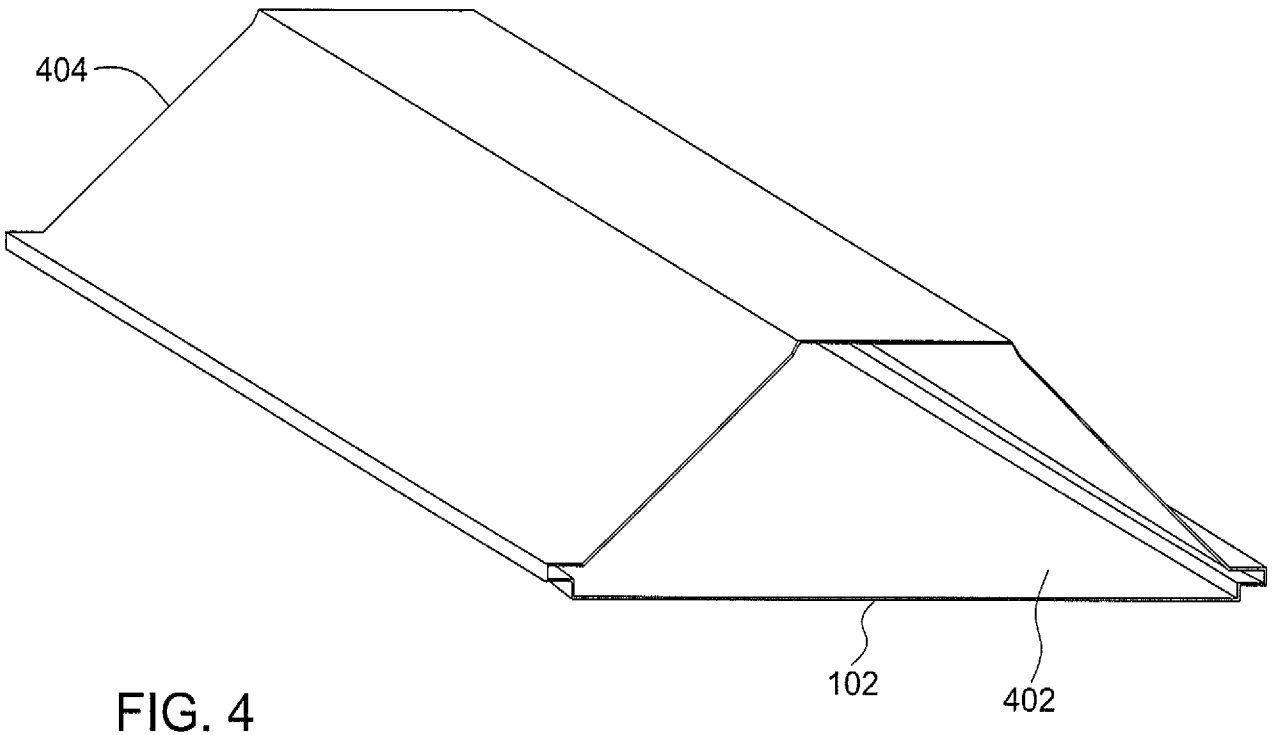
FIG. 4 depicts an isometric view of a molded housing.

In a further embodiment, the molded housing 102 may be fabricated using methods other than standard molding. For example, the molded housing 102 can consist of an extruded portion as shown in FIG. 4. A top opening 402 and a bottom opening 404 may be closed off with end pieces (not shown). In a further embodiment, the top opening 402 and the bottom opening 404 may be fully open.

The light source 108 may also include other optical or mechanical features not shown. For example, the light source 108 may have a heat sink integrated into the molded housing 102 to dissipate heat away from the light source 108. In addition, the light source 108 may include a reflector to direct the light towards the outer lens 150. These additional features may be installed inside the molded housing 102.

Figure 5:
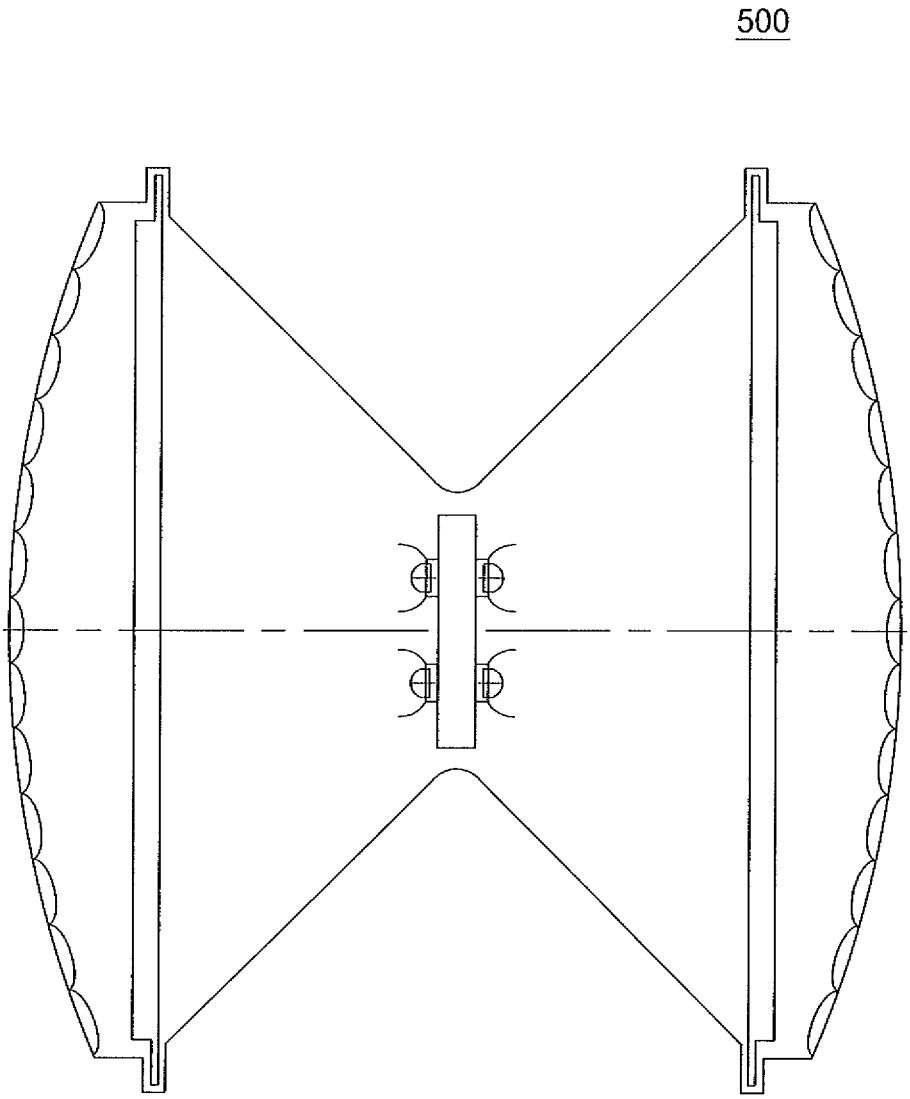
FIG. 5 depicts one example of a 2-way signal light.

In addition, it should be noted that although an integrated signal light head 100 having three light sources 108 is illustrated, any number of light sources 108 and any configuration of light sources 108 may be used. For example, a single light source 108 may be used for an integrated signal light head 100 and multiple integrated signal light heads 100 may be coupled together. In addition, the light sources 108 may be aligned vertically as illustrated in FIG. 1 or oriented horizontally. In addition, the molded housing 102 may be designed as multiple modules instead of a single module shown in FIG. 1. For example, there may be a power supply module and three light engine modules. The light engine modules may be designed to work in a nesting configuration. In addition, multiple integrated signal light heads 100 may be coupled together to form 2-way signal light 500 for each direction of a 2-way intersection as shown in the top view illustration of FIG. 5. In a further embodiment, multiple integrated signal light heads 100 may be coupled together to form a 4-way signal light for each direction of a 4-way intersection. The number of light sources 108 and configurations described above or only provided as examples and should not be considered limiting.

In one embodiment, the integrated signal light head 100 includes a mating surface 112. The mating surface 112 may be a universal mount that fits any pole or mounting surface associated with a particular application (e.g. a traffic light pole, a train rail, coupling for the 4-way signal light configuration, etc.).

The molded housing 102 may be coupled to a power supply compartment 104. In one embodiment, the power supply compartment 104 and the molded housing 102 may be molded as a single piece. The power supply compartment 104 and the molded housing 102 may comprise a plastic or metal.

The power supply compartment 104 includes a door 106. The door 106 may be sealed to prevent moisture from entering the power supply compartment 104 and protecting the interior of the power supply compartment 104 from inclement weather.

One or more power supplies 110 may be plugged in the power supply compartment 104. The one or more power supplies 110 are located remotely from the at least one light source 108 and power the at least one light source 108. The one or more power supplies 110 are plug-and-play. That is, the power supply 110 does not require any setup or wiring. To replace a power supply 110, a technician is simply required to pull out an old power supply and plug in a new power supply.

In one embodiment, the power supply compartment 104 may include one power supply 110 for a plurality of light sources. For example, if the integrated signal light head 100 includes a red light, a yellow light and a green light, a single power supply 110 may be programmed to power all three lights, but not necessarily at the same time.

In another embodiment, the power supply compartment 104 may include a plurality of power supplies 110. For example, if the integrated signal light head 100 includes a red light, a yellow light and a green light, the power supply compartment 104 may include three or more power supplies 110 (i.e. at least one power supply 110 for each light color).

The power supply compartment 104 may also include back up power supplies. For example one or more of the power supplies 110 may be back up or redundant power supplies.

As a result, the power supply 110 of the integrated signal light head 100 may be replaced more easily and efficiently than in prior designs. In prior designs, a technician may have had to access the power supply within a module that could be removed from the housing. This was a very difficult and laborious process.

In contrast, the novel design of the present integrated signal light head 100 allows the power supply 110 to be easily accessed without requiring removal of any modules in the housing. In other words, the power supply 110 may be removed independent of the at least one light source 108. That is, the power supply 110 may be replaced without replacing the at least one light source 108 that may still be functioning or have many years of life left. As a result, to replace the power supply 110 in the integrated signal light head 100, a technician simply needs to open the door 106 of the power supply compartment 104 to remove the old power supply 110 and insert a new power supply 110.

In addition, the novel design of the present integrated signal light head 100 provides cost savings. In previous designs, if the power supply could not be replaced, then the entire module including the light source would need to be replaced. This would waste a functioning light source due to the failure of the power supply. This would surely be the case when the integrated signal light head 100 uses LED based light sources 108 that may last many years beyond the life of the power supply 110. However, the present design allows the power supply 110 to be replaced without requiring replacement of the light source 108.

Additional cost savings are achieved due to the smaller size and weight of the integrated signal light head 100. Due to the use of LED based light sources 108 and elimination of the need to remove modules, less materials are used. For example, the previous design required multiple seals for each of the modules that were fitted to the signal head. The present design only requires a single seal. In addition, the integrated signal light head 100 requires less cost to manufacture due to the single molded housing that does not require installation of the separate modules of the previous designs.

The costs savings of the smaller size and weight is further propagated throughout the rest of the system. For example, for traffic signals, the mounting poles can be smaller and lighter and cabling used can be smaller and lighter. The use of LED based light sources 108 may allow the power supply 110 to be a 24-48 volt power supply. As a result, the design of the integrated signal light head 100 achieves substantial cost savings and efficiencies.

Figure 2:
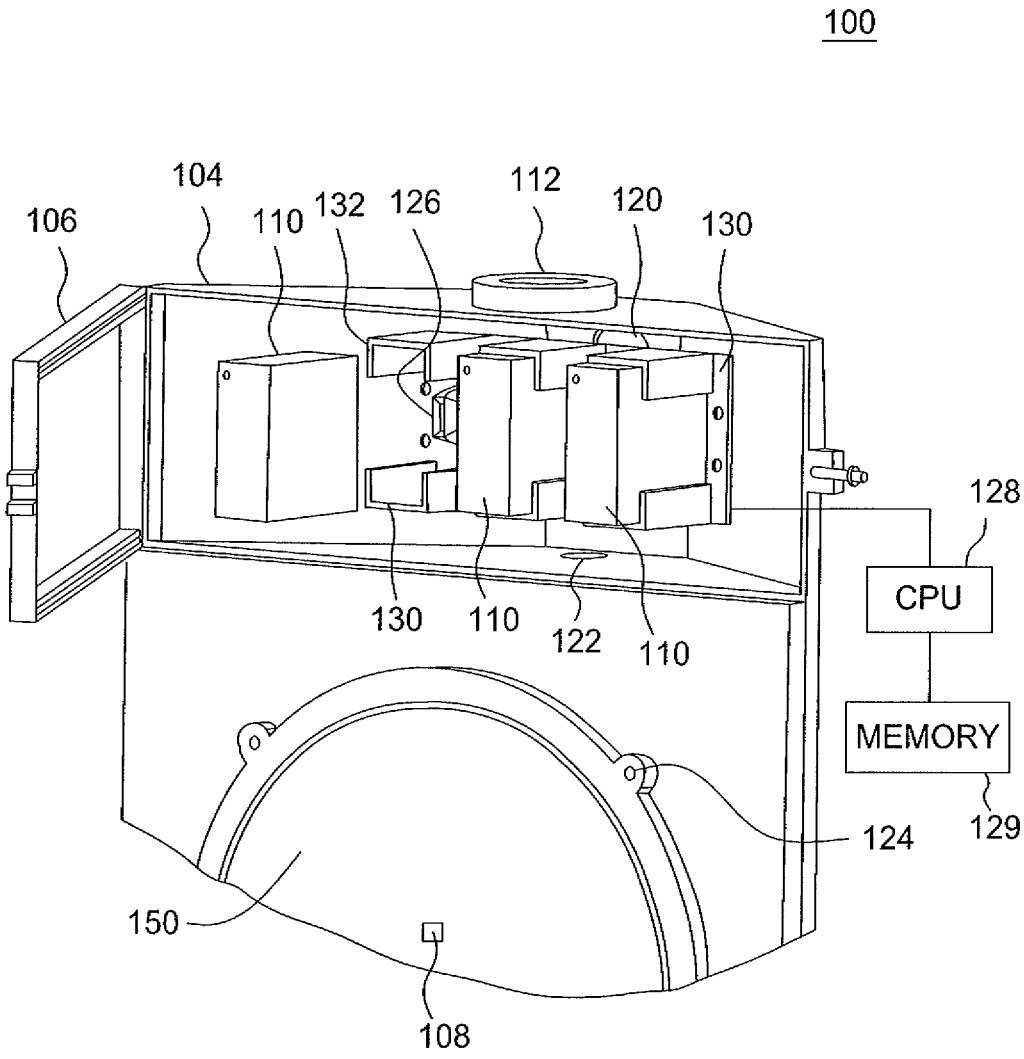
FIG. 2 depicts an enlarged view of a power supply compartment of the integrated signal light head.

FIG. 2 illustrates an enlarged view of the power supply compartment 104 of the integrated signal light head 100 as well as other features. As noted above, the one or more power supplies 110 are "plug and play". The power supply compartment 104 includes one or more guides 132 for aligning the power supply 110 to a female plug 126 that is coupled to a circuit board 130.

In one embodiment, the power supply compartment 104 may incorporate a secondary locking feature (not shown), e.g., a clasp, a locking tab, etc., to prevent the power supply 110 from being disconnected from the female plug 126 when exposed to vibration. In addition, the configuration of the power supply compartment 104 and the door 106 may be such that when the door 106 is closed it will provide a means of securing the power supply in place to prevent a disconnection of the power supply 110 from the female plug 126 when exposed to vibration. For example, the door 106 may be fitted with guides that "hug" the power supply 110 in place when the door 106 is closed or the door 106 may have a raised portion that "pushes" the power supply 110 into the female plug 126 when closed.

In addition, the circuit board 130 may include a processor (e.g. a central processing unit (CPU)) or an ASIC controller 128 and a computer readable storage medium or memory 129 (e.g. RAM, ROM, hard disk drive, flash drive and the like) for controlling operation of the one or more power supplies 110. For example, logic for controlling the operation of the one or more power supplies 110 may be stored in the memory 129 and executed by the processor 128.

As noted above, various configurations of the one or more power supplies 110 can be employed. In one embodiment, if a single power supply 110 is used to power a plurality of light sources 108, a program code may be stored in the memory 129 that diverts the power supply from a red light source to a green light source after a predetermined period of time. This logic would allow a single power supply 110 to be used, thereby providing additional costs savings by reducing the number of required power supplies 110 and reducing the overall weight of the integrated signal light head 100. The processor 128 may call the program code in memory 129 to execute the program code.

In other embodiments, a program code can be written to instruct the integrated signal light head 100 to divert to a back-up power supply 110 when a primary power supply 110 fails. For example, the program code could continually monitor a power level of the primary power supply 110 and switch over to the back-up power supply 110 if the power level fell below a predetermined threshold, e.g. 10 percent.

In addition, the program code executed by the processor may provide an indication that a power supply needs to be replaced. For example, an indicator light on the power supply 110 or in the power supply compartment 104 may change from a green color to a red color. Alternatively, the power supply compartment 104 may be equipped with a wireless transmitter that may transmit a wireless signal to a technician to indicate that a power supply 110 needs to be replaced if the power level falls below the predetermined threshold.

The examples provided above are only illustrative examples and should not be considered limiting. It should be noted that any type of logic needed to implement any configuration of the power supplies 110 may be stored in the memory 129 and executed by the processor 128.

The power supply compartment 104 may also include one or more sealed wiring cavities 120 and 122. The sealed wiring cavity 120 is to the outside and the sealed wiring cavity 122 is to the light compartment or the extruded molding 102. For example, the circuit board 130 may be wired to the light source 108 via the sealed wiring cavity 122. In addition, the control of the light source 108 and the one or more power supplies 110 may be controlled by an external controller. As a result, the circuit board 130 may be coupled to an external controller via the sealed wiring cavity 120.

The integrated signal light head 100 may also include mounting holes 124 on the outer lenses 150. The mounting holes 124 may be used to couple attachments onto the outer lens 150. For example, visors for traffic signal lights may be coupled to the outer lens 150 via the mounting holes 124.

Figure 3:
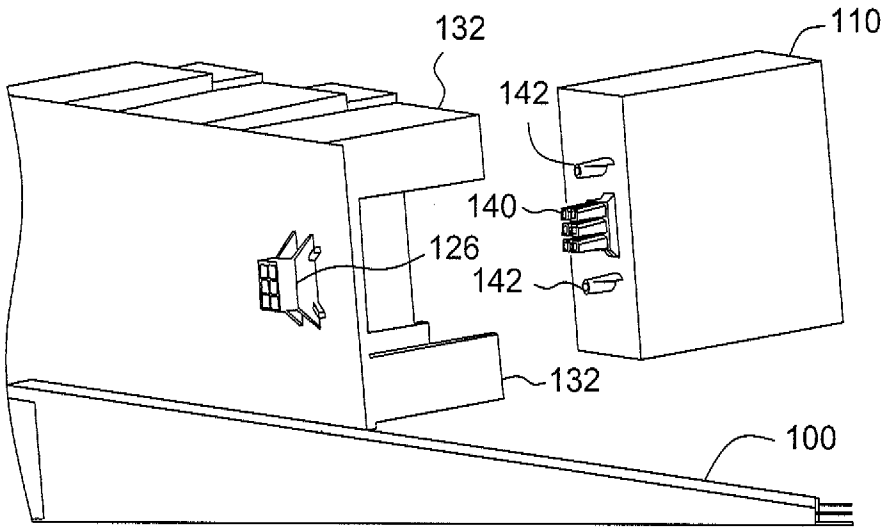
FIG. 3 depicts an enlarged view of connections of a power supply.

FIG. 3 illustrates an enlarged view of connections of the power supply 110. Each power supply 110 may include a male plug 140 and alignment pins 142. The alignment pins 142 in conjunction with the guides 132 allow the power supply 110 to be easily inserted into the female plug 126. The alignment pins 142 also provide additional support to prevent most of the weight of the power supply 110 from being applied to the male plug 140.

Figure 6:
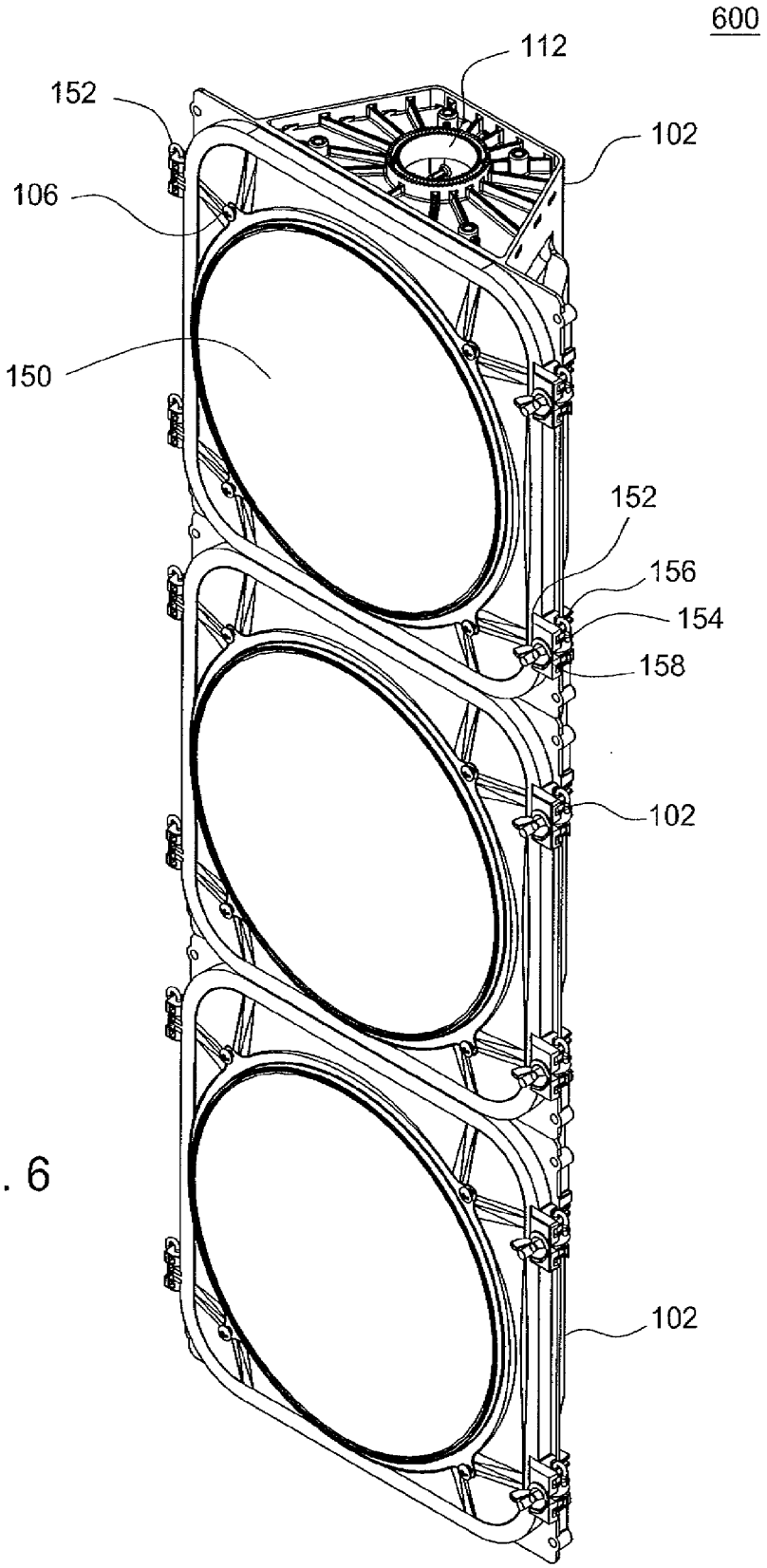
FIG. 6 depicts an isometric view of a second embodiment of an integrated signal light head.

FIG. 6 illustrates a second embodiment of an integrated signal light head 600. FIG. 6 illustrates the integrated signal light head comprising a plurality of molded housings 102. Each one of the molded housings 102 may include a mating surface 112 and a door 106 having one or more lenses 150. In one embodiment the one or more lenses 150 may be round in shape and may be rotated. In one embodiment the mating surface 112 may include a toothed mating surface and an opening to receive a mounting support structure, for example, a pole.

In one embodiment, the door 106 may be coupled to the molded housing 102 via one or more members 152 on the molded housing and one or more members 154 on the door 106. In one embodiment, a pin 156, for example a cotter pin, may be used to secure together the one or more members 152 on the molded housing and the one or more members 154 on the door 106. In one embodiment, the door may be closed via a fastening means, for example, a nut and bolt, a wing nut and bolt, and the like.

In one embodiment, one or more lenses 150 on the door 106 may include a plurality of lenses. For example, the lenses 150 may include an interior collimating Fresnel lens and an exterior spreading lens. The exterior spreading lens may have optical features that spread the light to wider angles. In one embodiment, the optical features on the exterior spreading lens may spread light more in the horizontal direction than the vertical direction. In one embodiment, the one or more lenses 150 may be keyed to ensure that at least one of the one or more lenses 150 is properly oriented with respect to the desired light output. For example, the keys may be a labeling within the molded housing 102 or a matching feature, such as for example, a notch, a slot, and the like, in order to fix the orientation of the one or more lenses 150 with respect to the molded housing 102. This may be important when an exterior lens has optical features that spread light in a non-symmetric light distribution pattern.

Figure 7:
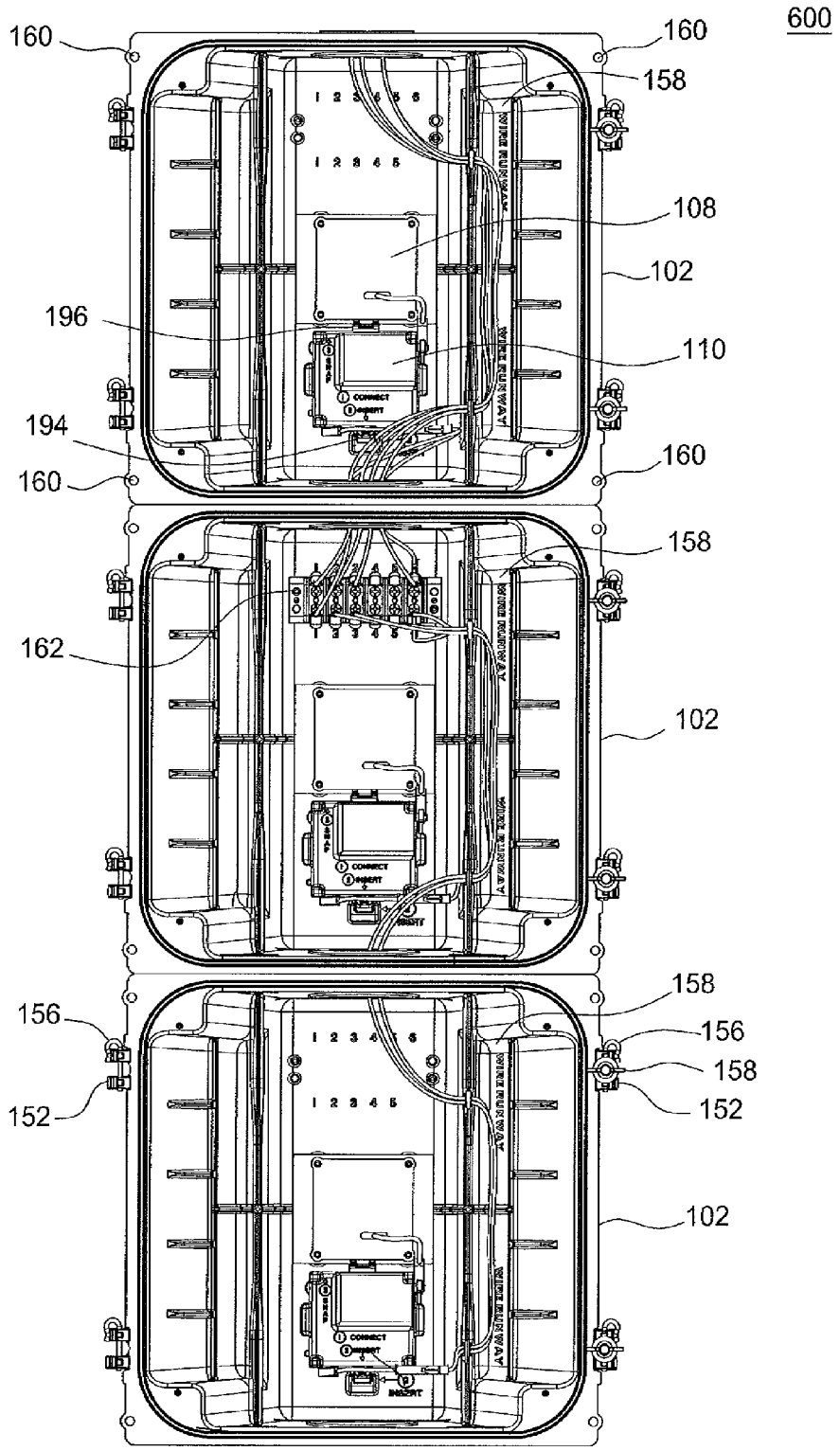
FIG. 7 depicts a front view of a plurality of molded housings assembled with a sealed power supply and a sealed light engine.

FIG. 7 illustrates an example front view of an interior of the plurality of molded housings 102 of the integrated signal light head 600. For example, each one of the molded housings 102 may be considered to be an individual signal light module. In one embodiment, each one of the molded housings 102 may include a light engine 108 that is sealed and a power supply 110 that is sealed. The light engine 108 is physically separated from the power supply 110. In other words, the power supply 110 is located remotely away from the light engine 108. Said another way, the light engine 108 and the power supply 110 are not located together within a traffic ball as done in previous traffic signal light designs. Rather, the power supply 110 is independently removable and accessible without having to open any additional housings or covers that are part of a traffic light ball that includes the light source. In one embodiment, the power supply 110 has separate and independent mounting hardware from the light engine 108. In one embodiment, the power supply 110 has a separate wiring harness than the light engine 108. In one embodiment, the power supply 110 may be removed without moving or affecting the light engine 108. In an alternate embodiment, the power supply 110 may be located on the same printed circuit board as the LEDs of the light engine 108. That is to say the components of the power supply 110 and the LEDs may be located on the same printed circuit board.

In addition, it should be noted that the light engine 108 is coupled to the molded housing 102 such that the light engine 108 is located forward of all the other components in the molded housing 102. For example, the power supply 110 is located as close to the back of the molded housing 102 such that there is less chance for light emitted by the light engine 108 to be obstructed by the power supply 110 or other components within the molded housing 102. This configuration may prevent any shadowing effects from being created by other components within the molded housing 102.

The power supply 110 may be coupled to the molded housing 108 via one or more tabs 194 and 196. The one or more tabs 194 and 196 are illustrated in further detail below. The one or more tabs 194 and 196 allow for quick snap, or plug-and-play, removal and coupling of the power supply 110.

In one embodiment, the integrated signal light head 600 may include a terminal block 162. The terminal block 162 may be used to electrically connect all of the power supplies 110 that power each one of the light engines 108 within their respective molded housing 102. In one embodiment, the terminal block 162 may be located in molded housing 102 that is centrally located. That is to say that molded housings 102 are located on each side of the molded housing 102 where the terminal block 162 is located.

In one embodiment, each one of the molded housings 102 may include a wire runway 158. The wire runway 158 provides an area for running wires securely through each of the molded housings 102. In addition, the wire runway 158 ensures that the wiring does not come into a path of light emitted by the light engine 108.

In one embodiment, each one of the molded housings 102 may also include one or more auxiliary mounting holes 160. For example, in some applications a back plane may be required for the integrated signal light head 600. In previous designs, a user may drill a larger hole through a previously designed signal light head to thread a nut and bolt through the larger hole to secure the back plane to the previously designed signal light head. Back planes are often used to block sunlight around the signal head. However, drilling such holes may negatively affect the integrity of the molded housing 102. As a result, the molded housings 102 are fabricated with the one or more auxiliary mounting holes 160 such that no additional drilling of holes is necessary for securely mounting a back plane to the integrated signal light head 600.

It should be noted that although three molded housings 102 are coupled together in FIG. 7, any number of molded housings 102 may be used. For example, the integrated signal light head may comprise a single molded housing 102. In addition, the molded housings 102 may be coupled together in any configuration, such as for example, horizontally, vertically, a dog house configuration, side-by-side, and the like.

Figure 8:
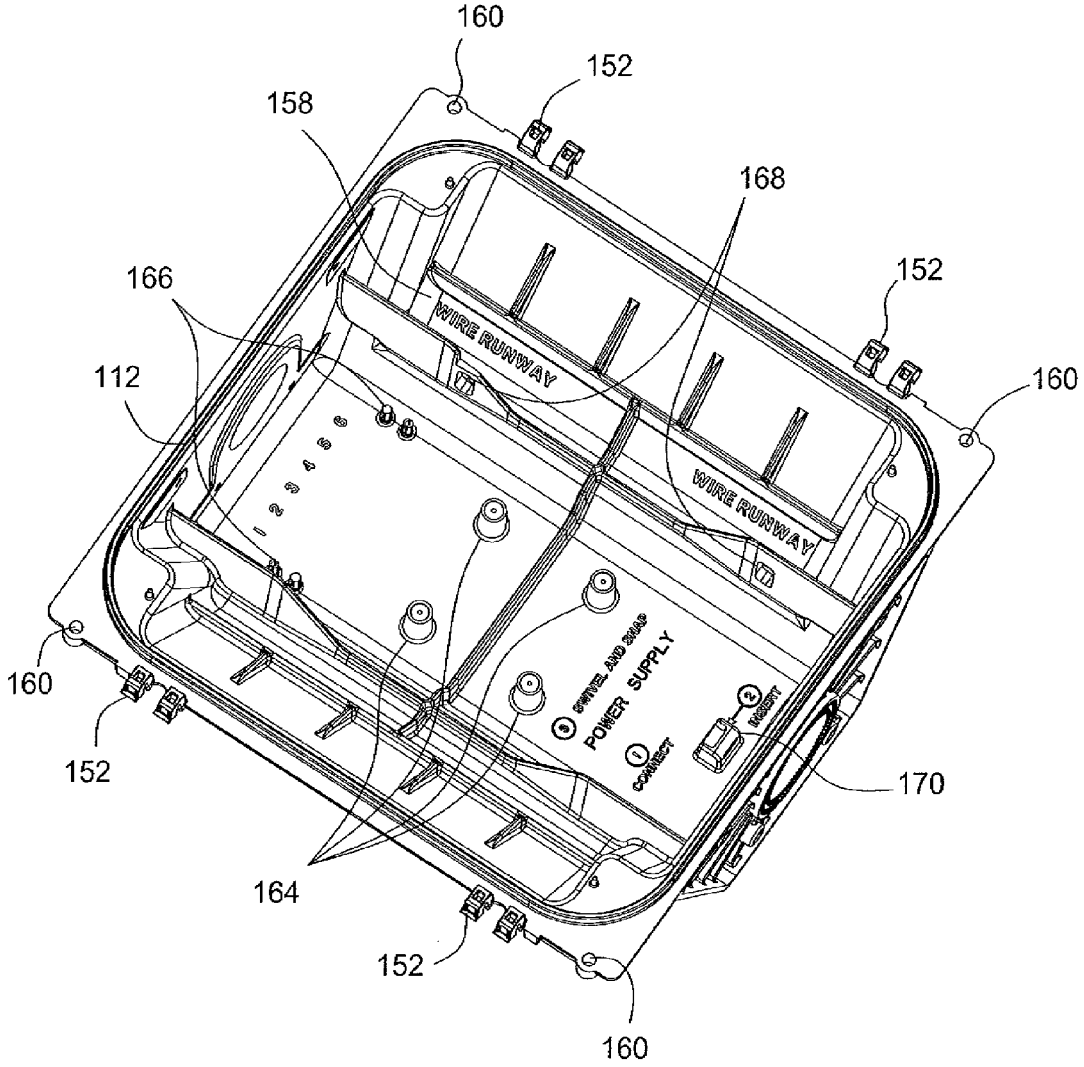
FIG. 8 depicts an isometric front view of a single molded housing.

FIG. 8 illustrates a more detailed isometric front view of a single molded housing 102. As noted above, the molded housing 102 may include one or more members 152 for coupling to the door 106. In one embodiment, the one or more members 152 may be located on opposite sides of the molded housing 102 such that the molded housing 102 may receive the door 106 on either one of the opposite sides. For example, the one or more members 152 may be located on a left side and a right side of the molded housing 102. As a result, the door 106 may be coupled to the molded housing 102 such that the door 106 may be opened from the left to right or from the right to left. If the molded housing 102 is rotated 90 degrees the door 106 may be opened from the top to bottom or from the bottom to top. In other words, the one or more members 152 allow for a universal configuration of the door 106 to the molded housing 102.

Such flexibility and the combination of the way the light engine 108 and the power supply 110 are coupled to the molded housing 102 provides ease of access when multiple molded housings 102 are coupled side-by-side in a doghouse configuration. For example, by coupling the door 106 to one molded housing 102 such that it opens from right to left and coupling another door 106 to another molded housing 102 such that is opens from left to right, both doors may be open at the same time.

Figure 11:
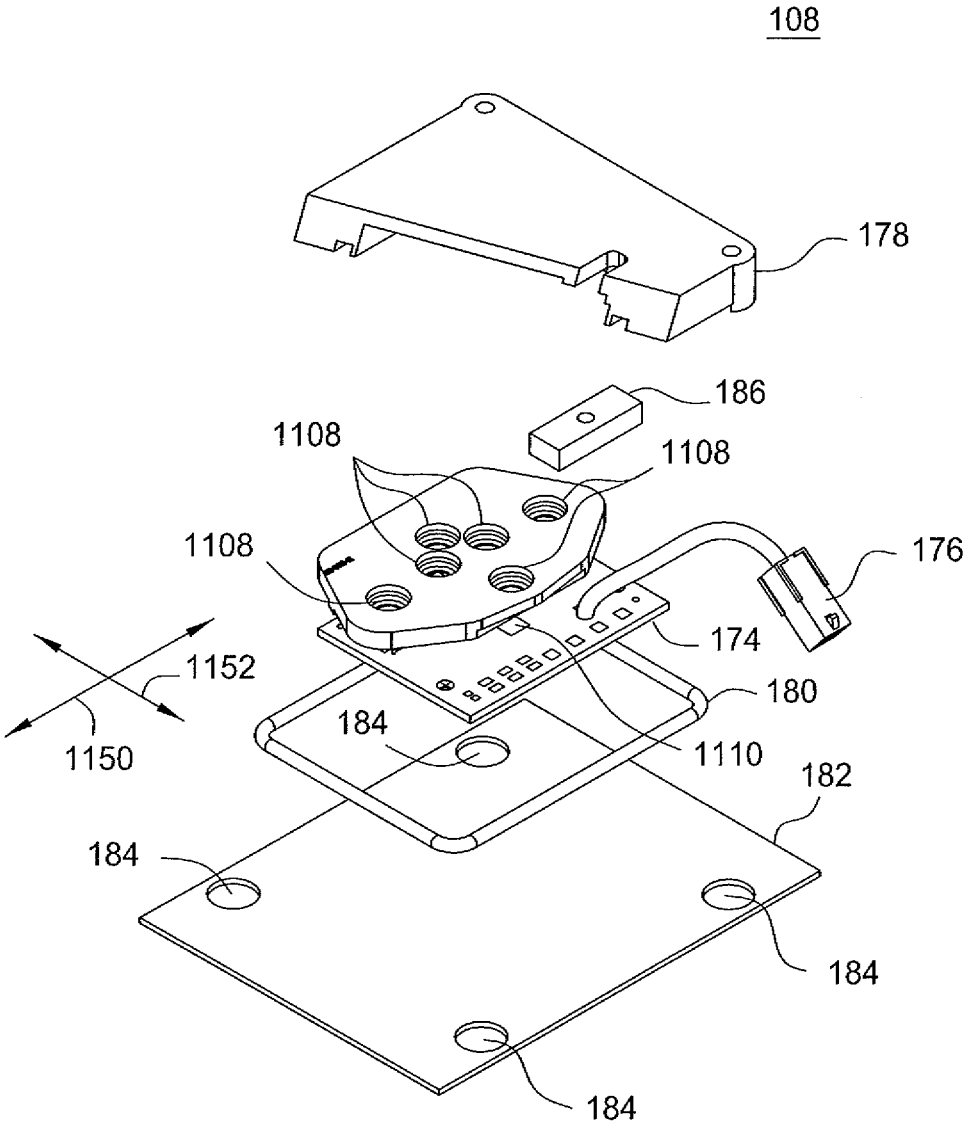
FIG. 11 depicts an exploded isometric view of a light engine.

The molded housing 102 may also include one more mounting bosses 164 for mounting the light engine 108. The mounting bosses 164 may be positioned in a symmetric pattern in two or more axes. The mounting bosses 164 are arranged such that the light engine 108 may be rotated with respect to the molded housing 102 in any direction depending on the configuration of the integrated signal light head 600. It should also be noted that the light engine 108 and the one or more lenses 150 on the door 106 are independently rotatable. In other words, since the one or more lenses 150 are separated from the light engine, unlike previous traffic ball designs, the light engine 108 may not need to be rotated if the one or more lenses 150 are rotated. In one embodiment, both the light engine 108 and the one or more lenses 150 may be independently rotated in the field. This is a very useful feature when the one or more LED light sources are positioned in a diamond pattern or other non-symmetric pattern in order to created the desired light out pattern. In one embodiment, and as shown in FIG. 11, the LEDs are spread out further in a first axis 1150 (e.g., a horizontal axis) than in a second axis 1152 (e.g., a vertical axis). In one embodiment, the LEDs are spread out further horizontally than vertically when the integrated signal light head is deployed in the field. The molded housing 102 may also include one or more posts 166 for mounting the terminal block 162.

As noted above, the molded housing 102 may include a wire runway 158 to ensure that the wiring does not cross in front of or interfere with a light output of the light engine 108. In one embodiment, the wire runway 158 may also include one or more holes 168 for routing the wiring through the wire runway 158 and securing the wiring to the wire runway 158.

In one embodiment, the molded housing 102 may also include a feature such as a slot 170 for receiving the tab 194 of the power supply 110. In one embodiment, the tab 196 of the power supply 110 may be coupled to a slot that consists of material removed from of an edge of the light engine 108.

Figure 9:
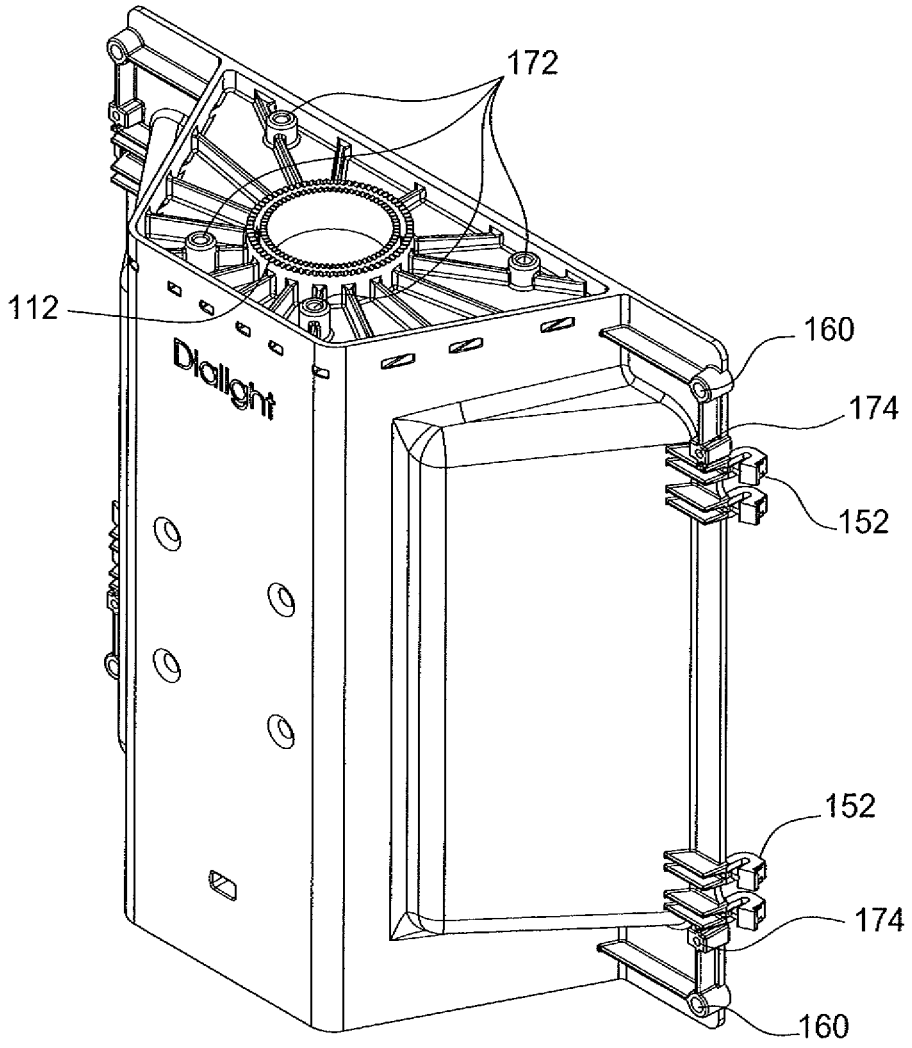
FIG. 9 depicts an isometric rear view of a single molded housing.

FIG. 9 illustrates a more detailed isometric rear view of the single molded housing 102. In one embodiment, as discussed above, the molded housing 102 may include both the auxiliary holes 160 for mounting a back plane and the standard holes 174 for mounting the back plane.

In one embodiment, the molded housing 102 may include one or more holes 172 on the top and bottom of the molded housing 102. The one or more holes 172 may be used to couple together multiple molded housings 102. In another embodiment, a large and hollow screw is used with a nut to couple together multiple molded housings 102. The large and hollow screw and nut may be located at the mating surfaces 112 of the multiple molded housings 102.

In one embodiment, the molded housing 102 may include a mating surface 112. In one embodiment, the mating surface may include a toothed mating surface and an opening or hole to receive a mounting structure, such as for example, a pole, into the molded housing 102 when deployed, for example, in a traffic intersection. In another embodiment, the molded housing 102 may be supported by a wire or cable when deployed, for example, in a traffic intersection. The opening may have a chosen shape such as a round hole. In another embodiment, the mating surface 112 may have a square shape. In another embodiment, the mating surface 112 may have an opening with any number of sides or be in any shape. The mating surface 112 is configured to be compatible with all currently available mounting surfaces and hardware.

Figure 10:
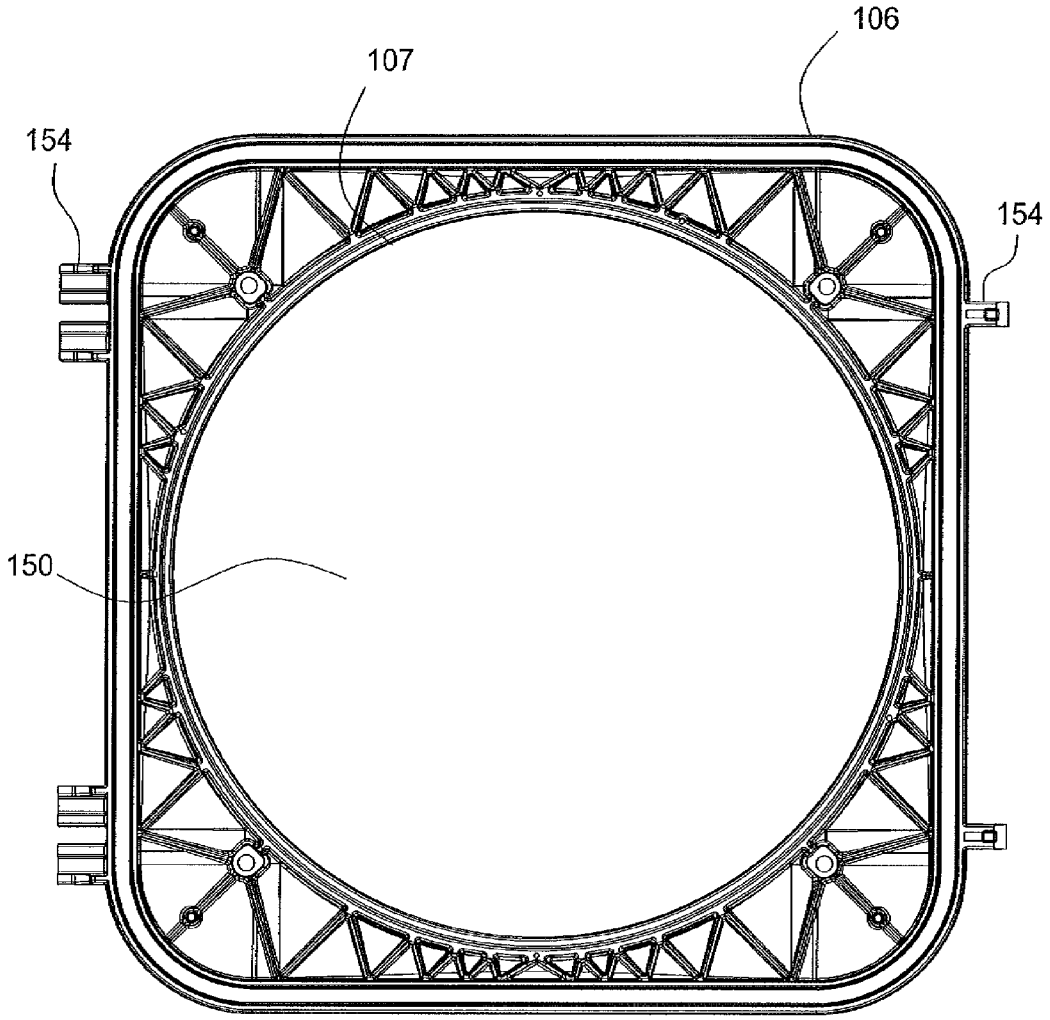
FIG. 10 depicts a back view of a door.

FIG. 10 illustrates a back view of the door 106. In one embodiment, the door 106 may include a gasket 107 that seals the one or more lenses 150 to the door 106 to prevent moisture from entering into the molded housing 102. It should be noted that the seal may be formed via any physical barrier, for example, using the gasket 107 described above, a coating and the like.

In one embodiment, as discussed above, the door 106 may also include one or more members 154. The one or more members 154 may be used to couple the door 106 to the molded housing 102 and to securely close the door 106 to the molded housing 102.

In one embodiment, the one or more lenses 150 may be attached to the door 106. The one or more lenses 150 may be fabricated from a plastic, such as for example, acrylic, polycarbonate, or glass.

In one embodiment, the one or more lenses 150 may be coated with material that provides for ultra violet (UV) light and scratch protection. In one embodiment, the molded housing 102 may also be coated for UV light and scratch protection. For example, the coating may include any type of coating such as a urethane coating. The coating may help the one or more lenses 150 from yellowing from the UV light exposure.

FIG. 11 illustrates an exploded view of the light engine 108. In one embodiment, the light engine 108 may include a printed circuit board 174 having an electrical connector 176, one or more reflector cups 1108, one or more light emitting diodes (LEDs) 1110 coupled to the printed circuit board 174, a foam gasket 186, a cover 178 and a metal plate 182.

Figure 12:
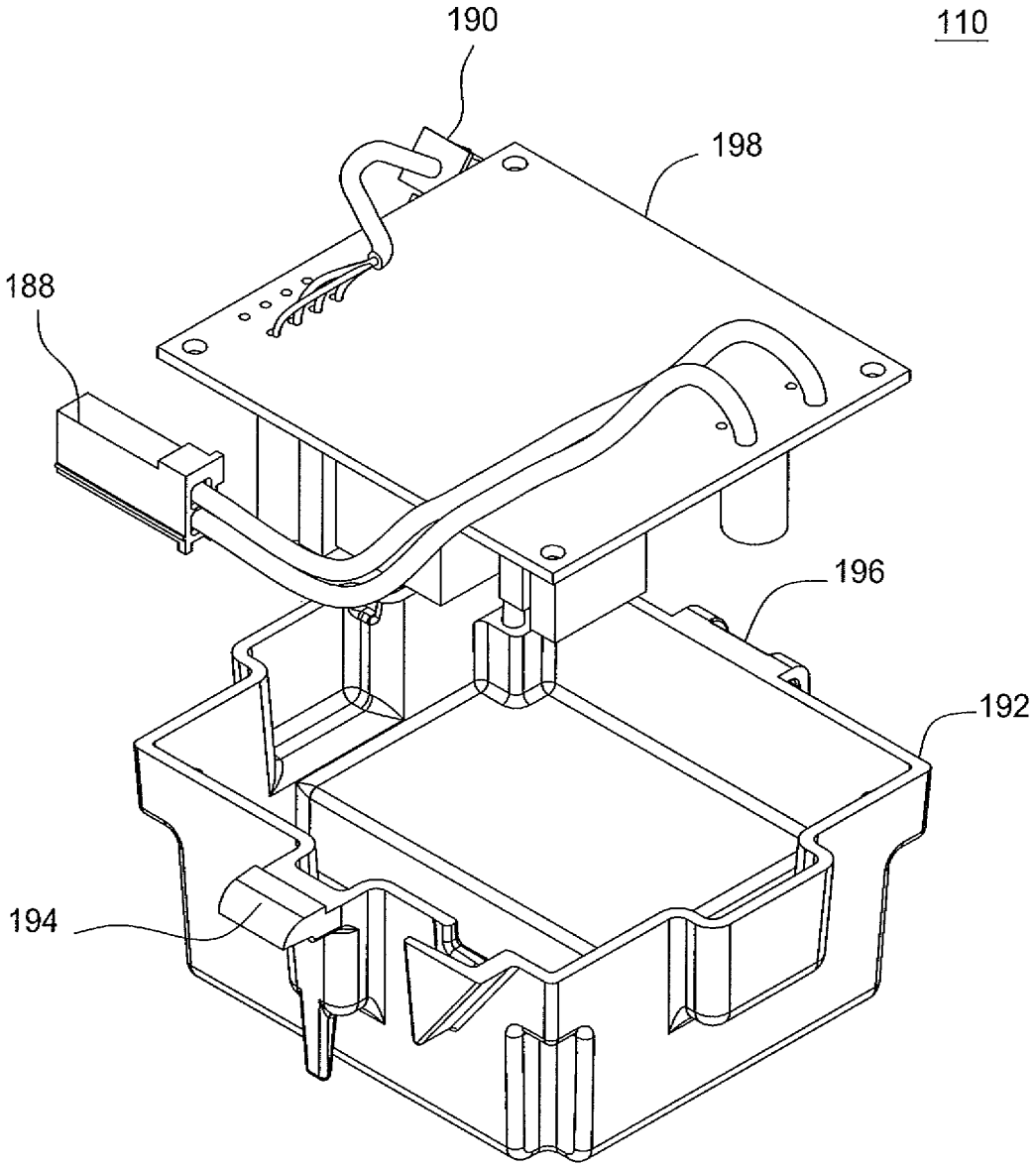
FIG. 12 depicts an exploded isometric view of a power supply.

In one embodiment, the electrical connector 176 may be a pin connector. As a result, the power supply 110 may have a corresponding pin connector (as shown in FIG. 12) to allow for an easy plug and play connection. In other words, no tools (e.g., a screw driver or wrench) or complicated wiring is needed. Rather, the power supply 110 may be simply "plugged in" to connect the light engine 108 to the power supply 110.

In one embodiment, the LEDs 1110 may be positioned in a non-symmetric pattern such as a diamond pattern such as shown in FIG. 11. This will help create a non-symmetric light pattern when the light is transmitted through the one or more lenses 150. The LEDs 1110 are essentially the object of a semi-imaging system and, therefore, a diamond pattern of the LEDs 1110 helps create a diamond pattern of the light output intensity distribution. The position of the LEDs 1110 and the optical features on the one or more lenses 150, therefore, must be designed and optimized together as a mutual optical system. The rotational orientation between the LEDs 1110 and the one or more lenses 150 is critical. In one embodiment, the LEDs 1110 are arranged in a non-circular pattern.

FIG. 11 illustrates a cut-away view of the cover 178 in order to better illustrate the other components of the light engine 108. In one embodiment, the cover 178 may be an optically clear or transparent material, for example a plastic or glass. The cover 178 may be coupled to the metal plate 182, for example, via fasteners, such as for example, snaps or a glue and sealed using a gasket 180 to prevent moisture from entering the light engine 108. In one embodiment, the cover 178 may have an opening to allow the wire to pass through from the printed circuited board 174. The foam gasket 186 and a glue, adhesive or potting material in the opening may be used to seal the opening used for the wires to pass through. This combination of the foam gasket 186 and the glue, the adhesive or the potting material may be used to prevent moisture from entering through the opening.

In one embodiment, the cover 178 may also include a notch feature for receiving the tab 196 of the power supply 110. The notch feature may simply allow the tab 196 to "click" into place.

In one embodiment, the metal plate 182 may include one or more holes 184 for coupling the light engine 108 to the molded housing 102. In one embodiment, the metal plate 182 may also serve has a heat sink to remove heat away from the light engine 108. The metal plate 182 may be fabricated from any thermally conductive plastic or metal, for example, aluminum, zinc or copper. The metal plate 182 may be disconnected from the back of the molded housing 102 or may be in direct contact with the molded housing 102 to remove heat away from the light engine 108 via the molded housing 102 and out to the atmosphere depending on the ambient temperatures and ambient environment in which the molded housing 102 is deployed.

FIG. 12 illustrates an exploded isometric view of the power supply 110. In one embodiment, the power supply 110 may include the components listed above as well as a printed circuit board 198 having electrical connections 188 and 190 and a cover 192.

In one embodiment, the electrical connections 188 and 190 may be pin connectors for making plug-and-play connections to the terminal block 162 and the light engine 108, respectively. In other words, the power supply 110 may be easily disconnected from the terminal block 162 and the light engine 108 by simply disconnecting the pin connectors 188 and 190.

The cover 192 may comprise a plastic material and be fabricated with one or more tabs 194 and 196. The tabs 194 and 196 allow for a simple and quick snap lock connection to the molded housing 102. In one embodiment, the tab 194 may be placed into the slot 170 and the tab 196 may be "clicked" into place in a slot or a notch feature of the light engine 108. In one embodiment, the tab 196 may be a spring loaded tab with a lip that allows the lip to catch under the notch feature of the light engine 108 to be secured. The tab 196 may then be pressed to free the lip such that the power supply 110 may be easily removed from the molded housing 102.

In one embodiment, the power supply 110 may be potted to further ensure that moisture does not enter the power supply 110. For example, after the printed circuit board 198 is placed into the cover 192, a potting material may be used to cover the printed circuit board 198 up to the top of edge of the cover 192.

In one embodiment, the light engine 108 and or the power supply 110 may also be sealed using a sealant coating that may also provide UV and chemical resistance in addition to the moisture resistance. The coating may be applied via spray, dip coat, conformal coating, vapor coating, molecular growth, vacuum and the like.

In another embodiment, a silicone-based polymer may be used to form the seal. In another embodiment, parylene may be used to form the seal. Parylene coatings ensure an even, conformal, lightweight coating that also penetrates into every crevice regardless of how seemingly inaccessible the crevice may be. Sealing with a coating may reduce the number of components as well as the size and weight of the overall light engine 108 and power supply. 110

It should be noted that the power supply 110 is physically separated from the light engine 108. In other words, the light engine 108 and the power supply 110 are not part of a common traffic ball or light module. Rather, the power supply 110 and the light engine 108 are independently coupled to the molded housing 102 and may be independently removable. As a result, even if the power supply 110 fails before the light engine 108, the power supply 110 may be easily removed via the plug-and-play electrical connections to the light engine 108 and the snap lock connection to the molded housing 102.

It should also be noted that the power supply 110 is not simply a battery power supply. Rather, the power supply 110 may include a direct current (DC) convertor to provide a constant current to the light engine 108. For example, the DC converter may be an alternating current (AC) to DC convertor or a DC to DC convertor.

The various embodiments of the integrated signal light head described above may be used in a variety of signaling applications. The integrated signal light head may used in, for example and not limited to, traffic signaling applications (including arrow signals, pedestrian signals, etc.), rail signaling applications, subway signaling applications, interior lighting applications, and the like.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An integrated signal light head, comprising:

a molded housing having an interior volume;

a sealed power supply coupled to the interior volume of the molded housing, wherein the sealed power supply is sealed via a first cover;

a sealed light engine coupled to the interior volume of the molded housing, wherein the sealed light engine comprises one or more light emitting diodes (LEDs), wherein the sealed light engine is sealed via a second cover, wherein the sealed light engine is physically separated from the sealed power supply;

a door coupled to the molded housing to provide access to the sealed power supply and the sealed light engine; and at least one lens coupled to the door, wherein the at least one lens and the sealed light engine are independently rotatable with respect to the molded housing.

2. The integrated signal light head of claim 1, wherein the at least one lens is keyed to fix an orientation of the at least one lens.

3. The integrated signal light head of claim 1, wherein the at least one lens comprises a collimating lens and an exterior spreading lens.

4. The integrated signal light head of claim 3, wherein the exterior spreading lens has an optical feature that spreads light in a non-symmetric light distribution pattern.

5. The integrated signal light head of claim 1, wherein the one or more LEDs are positioned in a non-symmetric pattern with respect to a first axis and a second axis.

6. The integrated signal light head of claim 1, wherein the door is coupled to the molded housing via a hinge, the hinge comprising:

one or more members on the molded housing; and one or more members on the door, wherein the one or more members on the molded housing and the one or more members on the door are mated by inserting a pin into the one or more members on the molded housing and the one or more members on the door that are coupled together.

7. The integrated signal light head of claim 6, wherein the one or more members are located on opposite sides of the molded housing to receive the door on either one of the opposite sides.

8. The integrated signal light head of claim 1, wherein the sealed power supply comprises a direct current (DC) convertor providing a constant current to the sealed light engine.

9. The integrated signal light head of claim 1, wherein the molded housing includes a wire runway.

10. The integrated signal light head of claim 1, wherein the molded housing includes one or more mounting openings for providing a variety of mounting configurations of the sealed light engine.

11. The integrated traffic signal light head of claim 1, wherein the sealed power supply is coupled to the interior volume via a snap lock.

12. An integrated traffic signal light head, comprising:

a plurality of molded housings coupled together, wherein each one of the plurality of molded housings comprises:

an interior volume;

a sealed power supply coupled to the interior volume of the molded housing, wherein the sealed power supply is sealed via a first cover;

a sealed light engine coupled to the interior volume of the molded housing, wherein the sealed light engine comprises one or more light emitting diodes (LEDs), wherein the sealed light engine is sealed via a second cover, wherein the sealed light engine is physically separated from the sealed power supply;

a door coupled to the molded housing to provide access to the sealed power supply and the sealed light engine; and at least one lens coupled to the door, wherein the at least one lens and the sealed light engine are independently rotatable with respect to the molded housing.

13. The integrated traffic signal light head of claim 12, wherein at least one of the plurality of molded housings includes a terminal block.

14. The integrated traffic signal light head of claim 13, wherein a center one of the plurality of molded housings includes the terminal block.

15. The integrated traffic signal light head of claim 13, wherein a wiring electrically connecting the sealed light engine to the terminal block is located in a wire runway to remove the wiring from a light path of the sealed light engine.

16. The integrated signal light head of claim 12, wherein the door is coupled to the molded housing via a hinge, the hinge comprising:

one or more members on the molded housing; and one or more members on the door, wherein the one or more members on the molded housing and the one or more members on the door are mated by inserting a pin into the one or more members on the molded housing and the one or more members on the door that are coupled together.

17. The integrated signal light head of claim 12, wherein the sealed power supply comprises a direct current (DC) convertor providing a constant current to the sealed light engine.

18. The integrated traffic signal light head of claim 12, wherein the sealed power supply is coupled to the interior volume via a snap lock.

19. An integrated signal light head, comprising:

a molded housing, the molded housing comprising:

an interior volume;

a plurality of mounting holes for providing a plurality of mounting configurations; and one or more snap hook features;

a sealed power supply comprising one or more snap hook features, wherein the sealed power supply is coupled to the interior volume of the molded housing via the one or more snap hook features of the sealed power supply coupled to the one or more snap hook features of the molded housing, wherein the sealed power supply is sealed via a first cover;

a sealed light engine coupled to the interior volume of the molded housing via one or more of the plurality of mounting holes of the molded housing, wherein the sealed light engine comprises one or more light emitting diodes (LEDs), wherein the sealed light engine is sealed via a second cover, wherein the sealed light engine is physically separated from the sealed power supply;

a hinged door coupled to the molded housing to provide access to the sealed power supply and the sealed light engine; and at least one lens coupled to the hinged door, wherein the at least one lens and the sealed light engine are independently rotatable with respect to the molded housing.

* * * * *